United States Patent [19]

Moore, Jr.

[11] 4,452,207

[45] Jun. 5, 1984

[54] FUEL/AIR RATIO CONTROL APPARATUS FOR A RECIPROCATING AIRCRAFT ENGINE

[75] Inventor: Robert G. Moore, Jr., South Bend, Ind.

[73] Assignee: The Bendix Corporation, Southfield, Mich.

[21] Appl. No.: 399,516

[22] Filed: Jul. 19, 1982

[51] Int. Cl.[3] ..... F02B 3/00; F02M 39/00

[52] U.S. Cl. ..... 123/440; 123/489; 123/478

[58] Field of Search ..... 123/489, 440, 478

[56] References Cited

U.S. PATENT DOCUMENTS

| | | | |
|---|---|---|---|
| 3,923,016 | 12/1975 | Hoshi | 123/489 |
| 3,926,154 | 12/1975 | Williams | 123/489 |
| 3,938,479 | 2/1976 | Oberstadt | 123/489 |
| 4,033,172 | 7/1977 | Morton | 123/489 |
| 4,040,394 | 8/1977 | Wahl et al. | 123/489 |
| 4,170,969 | 10/1979 | Asano | 123/489 |
| 4,210,114 | 7/1980 | Watanabe | 123/489 |
| 4,248,196 | 2/1981 | Toelle | 123/489 |

*Primary Examiner*—Raymond A. Nelli
*Attorney, Agent, or Firm*—Ken C. Decker

[57] ABSTRACT

A fuel/air ratio control apparatus for a reciprocating engine used in light aircraft including a fuel metering apparatus (32) and a fuel/air ratio controller (40). The controller (40) generates an electrical signal (Wf/Wa) indicative of a desired fuel/air ratio based upon the flight condition of the aircraft and the metering apparatus (32) meters fuel flow (Wf) according to the mass airflow ingested into the engine. The desired fuel/air ratio is a best power ratio (Wf/Wa (2)) for takeoff and climb conditions and a best economy ratio (Wf/Wa (3)) for cruise conditions as derived from the exhaust gas temperature. These ratios are limited by a ratio (Wf/Wa (1)) based upon the maximum cylinder head temperature tolerable for a particular flight condition.

7 Claims, 6 Drawing Figures

FUEL/AIR RATIO CONTROL APPARATUS FOR A RECIPROCATING AIRCRAFT ENGINE

The invention pertains generally to a fuel/air ratio control apparatus for a reciprocating aircraft engine and is more particularly directed to such apparatus having exhaust gas temperature (EGT) control and cylinder head temperature (CHT) limiting.

In a paper entitled "Fuel System Requirements for Light Aircraft Turbocharged Reciprocating Engines" published by the Society of Automotive Engineers in April of 1974, J. M. Kirwin and E. A. Hasse discuss various parameters of a reciprocating engine as a function of the fuel/air (F/A) ratio. In this paper it is pointed out that a reciprocating engine for light aircraft will operate on its power curve through a range of F/A ratios of 0.055–0.12 while still developing 85% of the maximum available horsepower at these two extreme conditions. While enriching the mixture, a 100% power point is developed at approximately a F/A ratio of 0.075 and the power curve continues to be relatively flat before beginning to fall off at F/A ratios of about 0.09. Leaning the engine to F/A ratios below 0.07 and approaching F/A ratios of 0.06 will cause engine power to drop off dramatically.

It is further developed in the paper that the CHT and the EGT are also functions of the F/A ratio. EGT increases with increasing F/A ratio from 0.055–0.065 as more fuel is burned and heat is generated. The EGT then peaks essentially at the stoichiometric ratio and decreases for increasing F/A ratios as additional fuel produces a cooling effect on the engine. The CHT follows a similar pattern but peaks at a slightly richer F/A ratio than the EGT.

On either side of the EGT peak are different operating ranges for the engine which are desirable during certain flight conditions of the aircraft. On the lean side (F/A ratios less than the peak EGT) is a best economy range and on the rich side (F/A ratios greater than the peak EGT) is a best power range. The best power range encompasses those fuel/air ratios for which engine power is 100% of that available at a specific engine speed and throttle setting, while the best economy range encompasses those fuel/air ratios at which the engine will run lean while still developing at least 85% available power.

Pilots are aware of the EGT curve as a function of F/A ratio and use it as a technique for enhancing performance for light aircraft equipped with a fuel control apparatus having a manual (F/A ratio) mixture control. Generally, such fuel control apparatus are designed to automatically meter a predetermined fuel/air ratio based upon the actual inlet airflow. Normally, a full rich F/A ratio of approximately 0.10 is metered when the manual mixture control is set to full rich. This F/A ratio provides extra fuel for cooling during maximum power flight conditions, such as takeoff or full power. During cruise with the manual mixture control still at full rich, the fuel control apparatus will meter a slightly rich F/A ratio of approximately 0.08. The F/A ratios that are automatically metered are set for the most adverse conditions and are inefficient during much of the normal aircraft operation. For more efficient operation the pilot manually leans the mixture in accordance with his knowledge of the EGT, CHT fuel/air ratio correspondence.

Takeoff conditions are obtained by setting the manual mixture control to full rich and advancing the prop speed lever and throttle lever to the maximum positions. During takeoff, the pilot monitors the CHT and opens the cowl flaps to insure that the CHT limit is not exceeded. The aircraft will then normally enter a climb or cruise climb phase of operation where the best power range of the engine is desired. The pilot produces this condition by reducing engine speed slightly and trimming the F/A ratio with the manual mixture valve. The pilot monitors the EGT or CHT gauge while leaning the F/A ratio and stops when the engine EGT or CHT increases to a predetermined point. After climbing to altitude, the aircraft enters a cruise phase or condition where the pilot usually desires the best economy from the engine. Pilots have in the past determined the best economy point of operation by leaning the F/A mixture until the engine power drops sharply or engine misfire occurs. The F/A ratio is then increased until the engine runs smoothly and/or the EGT is at a predetermined value below its peak value.

Although the pilot can operate his aircraft more efficiently in this manner, this technique is not a preferred method of operation. Initially, it puts a burden on the pilot to understand and operate the aircraft in the manner just outlined. During flight, the attention of the pilot could be more advantageously used in flying the aircraft, navigating, and communicating with the air traffic control. Efficiently trimming the engine for varying flight conditions of the aircraft should best be handled automatically.

The manual method is additionally inaccurate in that the pilot must monitor a gauge with a needle indicating exhaust gas temperature. The needle position must be interpreted correctly to determine whether the method is successfully bringing the engine operation to the point desired. Reading errors, gauge errors, and temperature sensor errors may tend to accumulate to the point at which a pilot believes he is operating at the best economy or best power point of the engine while in reality a much different fuel/air ratio is chosen.

Much of the inaccuracy of pilot controlled F/A ratio stems from the fact the peak exhaust gas temperature varies with power setting. Therefore, after the pilot has adjusted the power setting for any reason he may be required to readjust the fuel/air ratio mixture to account for the exhaust gas temperature peak change. This requires F/A ratio adjustment until the new peak is found and further adjustment to operate a particular number of degrees on either side.

Generally, because of the significant time factor involved in adjusting to best power EGT during takeoff and for short climbs, an inefficient full rich fuel/air ratio is used which robs the engine of maximum power and wastes fuel. Although it is known that full rich mixture is only needed for a maximum cooling day where high air temperature is taxing the cooling system of the engine to the limit, pilots are instructed to use the full rich mixture level for all takeoff and many short climb conditions. Therefore, a manual mixture-leaning technique during these conditions is not time effective for the pilot nor is it generally approved by the operating instructions of the aircraft.

SUMMARY OF THE INVENTION

The invention provides a fuel/air ratio control apparatus for a reciprocating aircraft engine which permits the pilot to automatically select a best economy or best power fuel/air ratio depending upon the flight conditions chosen. For a pilot-initiated flight condition which requires the aircraft to take off and gain altitude or climb, the fuel/air ratio control apparatus selects a best power fuel/air ratio for the engine while for a pilot-initiated flight condition which requires the aircraft to sustain altitude or cruise, the apparatus selects a best economy fuel/air ratio for the engine. Additionally, a means is provided to limit the cylinder head temperature of the engine to a maximum reference value during takeoff, cruise, and climb conditions.

Advantages of the fuel/air ratio control apparatus are a more efficient and economical use of fuel and thus engine power without the danger of overheating the engine.

Initially, under takeoff conditions, the control apparatus enrichens fuel/air ratio only to the point necessary for the best power of the engine by a closed loop based on exhaust gas temperature. If a richer fuel/air ratio than this is necessary because the engine cooling system is being overtaxed, the apparatus enrichens the ratio beyond the best power ratio only to the point necessary for cooling by measuring the actual cylinder head temperature. The control apparatus operates the engine at the most efficient ratio rather than a full rich ratio as has been accomplished previously. The difference between operating at the most efficient point for the engine and the normal full rich point during takeoff can contribute significant fuel savings. Varying conditions of altitude, humidity, air temperature, engine condition, and cowl flap position are automatically compensated for by the closed loop.

Thereafter, when the engine is being operated in the climb mode, the fuel/air ratio is automatically held at the best power point by a closed loop. Since the control measures the actual fuel/air ratio based upon an exhaust gas temperature probe, the regulation to the best power point can be more exact over varying ambient conditions, altitudes, and power settings. Additionally, the engine is protected from destructive temperatures by the cylinder head temperature limiting means during this flight condition without distracting the attention of the pilot from flying the aircraft.

When the pilot indicates that a cruise condition is desired, the control automatically switches fuel/air ratios from the best power to the best economy point for varying ambient conditions, altitudes, and power settings. In the cruise mode the cylinder head temmperature limiting means also protects the engine from destructive temperatures without the need of pilot intervention.

In a preferred embodiment, the invention comprises a fuel metering apparatus which regulates a fuel flow (Wf) based upon a measured air flow (Wa) and a desired fuel/air ratio (Wf/Wa). The desired fuel/air ratio (Wf/Wa) is generated as an electrical signal from a closed loop electronic fuel/air ratio controller having the actual exhaust gas temperature and actual cylinder head temperature input as feedback parameters indicative of the actual fuel/air ratio being metered to the engine. The fuel/air ratio controller differences the exhaust gas temperature with a best economy reference and a best power reference to form error signals which drive separate control loops scheduling the desired fuel/air ratio based upon the errors.

In a third control loop the actual cylinder head temperature is differenced with a variable limiting value for engine cylinder head temperature from which an error signal is derived. A reference limit for each flight condition is generated based upon the maximum desired cylinder head temperature for that condition. A third desired fuel/air ratio signal is scheduled from this error.

The fuel/air ratio controller further includes means for selecting between the desired fuel/air ratio signals from the three control loops based upon flight conditions. A flight condition indicator generates electrical signals indicative of a takeoff condition, a climb condition, or a cruise condition by decoding the position of the propeller speed lever.

The selecting means receives the flight condition indications and selects the richer of the desired fuel/air ratio outputs of the cylinder head temperature limit loop and the best power loop for a takeoff, or climb condition, and the richer of the desired fuel/air ratio outputs of the cylinder head temperature limit loop and the best economy power loop for a cruise condition.

These and other objects, features, aspects, and advantages of the invention will be more fully described and better understood if a reading of the following detailed description is undertaken in conjunction with the attached drawings, wherein:

DETAILED DESCRIPTION OF THE PREFERRED EMBODIMENT

Figure 1:
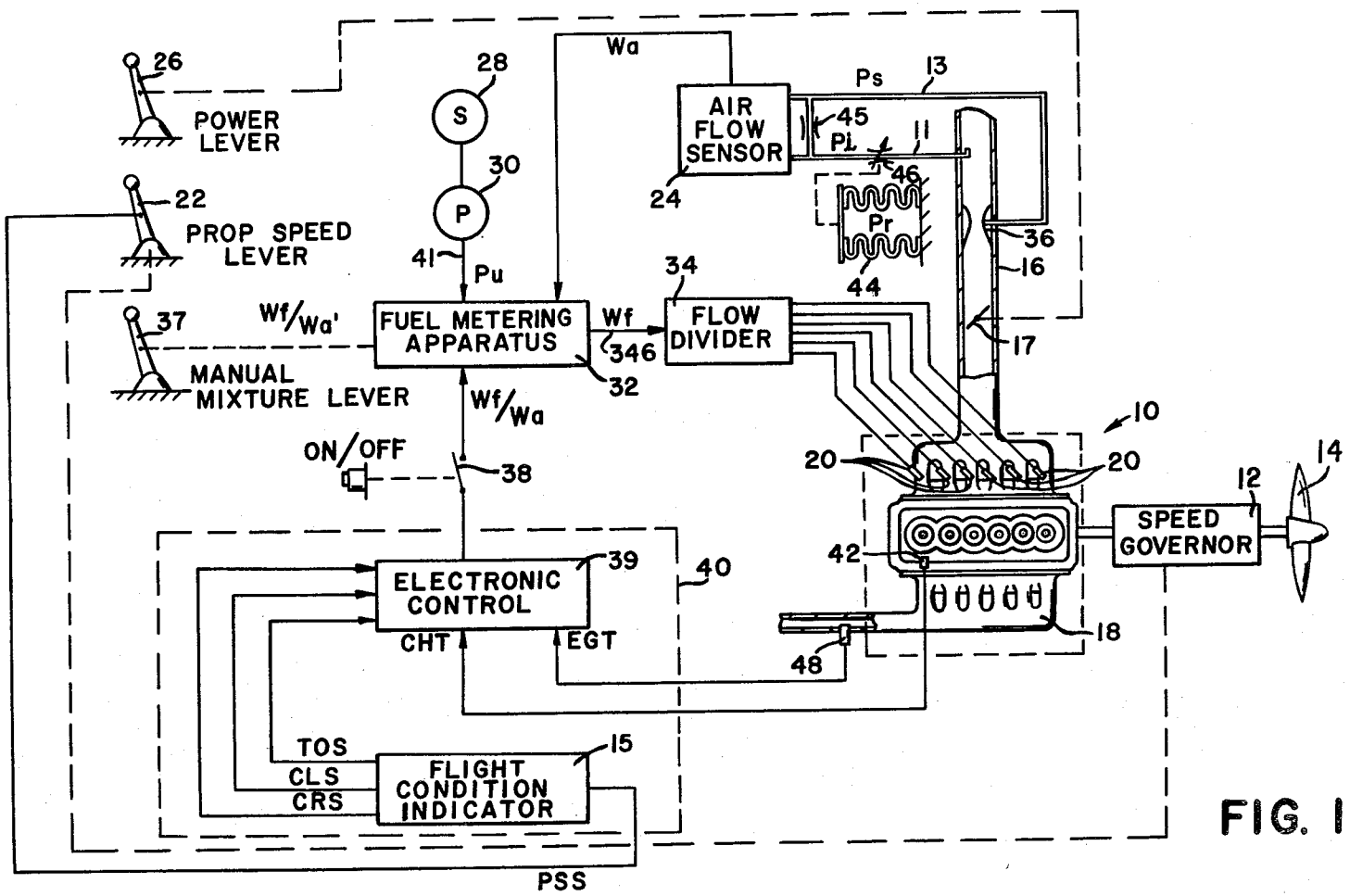
FIG. 1 is a system block diagram of a fuel/air ratio control apparatus for a reciprocating aircraft engine constructed in accordance with the teachings of the invention.

With attention now directed to FIG. 1 there is shown a fuel/air ratio control apparatus for a reciprocating aircraft engine 10 constructed in accordance with the teachings of the invention. The engine 10, as is conventionally known, comprises an intake manifold 16 which supplies air to the engine cylinders. The air which is mixed with fuel from fuel injector nozzles 20 enters the engine during an intake cycle. The fuel/air mixture is thereafter combusted in the individual cylinders of the engine 10 and exhausted through an exhaust manifold 18 to the atmosphere.

The engine through a speed governor 12 powers a variable pitch propeller 14 producing thrust to fly the aircraft. Thrust is varied by the pilot operating a prop speed lever 22 which changes the reference or set point of the speed governor 12 and the engine power lever 26. The speed governor regulates the speed of the prop 14 to the set point by varying the pitch of the propeller blade. The power output from the engine is controlled conventionally by a butterfly-type throttle plate 17 whose angle and hence cross-sectional area is controlled by a power lever 26. By coordinating the power lever 26 and the prop speed lever 22, the pilot can produce a number of power and speed outputs from the engine-propeller combination that are advantageous to the particular flight conditions desired.

Figure 3:
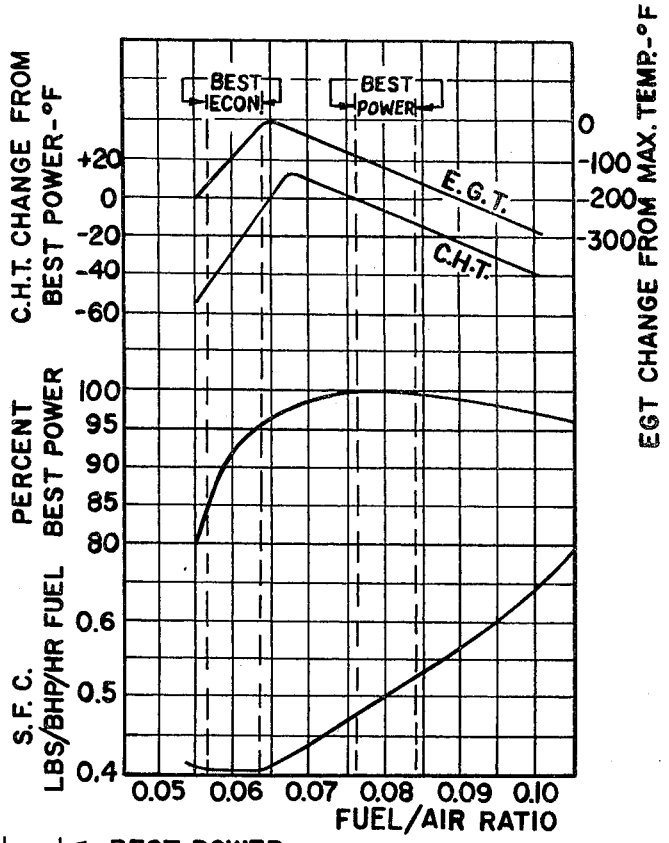
FIG. 3 is a pictorial representation of various operating parameters of a reciprocating aircraft engine as a function of fuel/air ratio.

For this typical aircraft configuration, the fuel/air ratio requirements for operating an engine are set forth in FIG. 3. The Figure illustrates representative curves of EGT, CHT, power, and specific fuel consumption as a function of fuel/air ratio. Such graphical representations can be compiled from empirical data for any particular aircraft.

To calculate the most advantageous fuel/air ratio for the engine during differing flight conditions, an automatic fuel/air ratio control apparatus 40 is provided. A fuel metering apparatus 32 receives fuel from a source 28 such as a wing tank which is pressurized with a pump 30 to provide a substantially constant fuel pressure Pu. This pressurized fuel is input to a fuel metering apparatus 32 which receives as another input an electronic signal from the electronic control 39 which is indicative of a desired fuel/air ratio (Wf/Wa). A third input to the fuel metering apparatus 32 is from an air flow sensor 24 which measures the amount of airflow, Wa, being ingested into the engine.

In this particular case the airflow sensor is shown as a differential pressure measurement apparatus which differences an impact pressure, Pi, formed at the inlet of the throat of the input manifold 16 and a static pressure, Ps, formed at a port of a venturi 36. The difference of these two pressures Ps-Pi is a function of the airflow being drawn into the engine past the throttle plate 17. Further, a variable bleed 46 may be positioned by its attachment to a bellows apparatus 44 scaled to a reference pressure Pr. The bellows 44 varies the area of the bleed opening with respect to ambient pressure and temperature to provide air density compensation. Thus, the airflow sensor produces a differential pressure Ps-Pi which is a function of the engine mass airflow.

From the three inputs, the fuel metering apparatus 32 provides a fuel flow, Wf, by metering the pressurized fuel input Pu in accordance with the multiplication of the desired fuel/air ratio, Wf/Wa, times the actual airflow, Wa. The gross metered fuel flow, Wf, for the entire engine is thereafter received by a flow divider 34 which in conjunction with the injector fuel nozzles 20, separates the overall flow into relatively equivalent amounts such that each injector 20 inputs the correct fuel/air ratio to the individual cylinders of engine 10.

The fuel metering apparatus 32, as will be more fully explained hereinafter, is preferably a hydromechanical fuel metering device with an electronic trim being controlled by the electrical signal Wf/Wa. However, it is well within the scope of the invention to provide a fuel metering apparatus 32 which receives the electronic signal, Wf/Wa, and multiplies it by an electronic airflow signal, Wa, to position a proportional solenoid valve producing the fuel flow, Wf, from the input pressurized fuel Pu. Further, although the invention is described as being particularly adapted to fuel injected engines, it should be evident that the gross fuel flow, Wf, could just as easily be input to an atomizing device of a pressurized carburetor or the like.

The fuel metering apparatus 32, although automatically controlled by the primary fuel/air ratio signal Wf/Wa, may also be controlled by a manual mixture lever 37, which the pilot can rotate to control a secondary fuel/air ratio signal Wf/Wa'. The manual mixture lever 37 may be used as a backup system to control the F/A ratio in exigent circumstances because of failure of the electronic fuel/air ratio controller or even as a preference. To this extent, the electronic fuel/air ratio controller 40 may be disconnected by an on/off switch 38 breaking the circuit from the controller to the fuel metering apparatus 32 which establishes the maximum F/A ratio.

The fuel/air ratio controller 40 has an electronic control 39 which schedules the fuel/air ratio signal, Wf/Wa, as a function of two input parameters. The initial input parameter is the cylinder head temperature, CHT, of the engine and the second parameter is the exhaust gas temperature, EGT, of the engine 10. The cylinder head temperature, CHT, is developed by a temperature sensor 42 such as a thermocouple located in intimate contact with the head of at least one cylinder of the engine 10. Particularly, cylinder head temperature is a limiting parameter which will cause damage to the engine if it is exceeded for any period of time. Therefore, the temperature sensor 42 is positioned to read the cylinder temperature of the engine that usually exhibits the hottest temperature for the particular aircraft. In tightly cowled aircraft the hottest cylinder is generally the one furtherest from the air intake or the last of an in-line engine as shown. Alternatively, for the control shown all cylinder heads could have a temperature probe and the highest reading selected as the input parameter CHT.

The exhaust gas temperature EGT is measured by a temperature sensor 48 such as a thermocouple located in the exhaust manifold 18 at a position to sample the composite exhaust gases of all cylinders. In this manner the temperature sensor 48 averages the exhaust gas temperature of all cylinders and produces the input parameter EGT as a measurement thereof. Again, as an alternative, it is well within the skill of the art to provide each cylinder with exhaust temperature sensor and select the highest cylinder exhaust temperature as the input parameter EGT to the fuel air/ratio control 40.

The fuel/air ratio controller 40 schedules the fuel/air ratio signal Wf/Wa as a function of either CHT or EGT or a combination of both, according to a mode selection based upon flight condition. The fuel/air ratio controller 40 basically operates in three modes which are takeoff and landing, climb, and cruise, developed by a flight condition indicator 15 receiving an indication of these conditions from the pilot. The flight condition indicator 15 decodes these representations into three mode signals TOS, CLS, and CRS, indicative of takeoff and landing, climb, and cruise flight conditions, respectively. It should be noted that the propeller speed lever position (full speed) will be the same for takeoff and landing with only the power level at different extremes. For the flight condition indicator illustrated, the pilot indication of the desired flight condition is generated by a signal PSS which corresponds to the position of the propeller speed lever 22. It is well within the ordinary skill of the art, however, to provide different indications of the flight conditions of takeoff, climb, and cruise for a reciprocating aircraft engine. For example, as an alternative, individual switches or buttons that the pilot can operate could be used to determine these modes.

Figure 2:
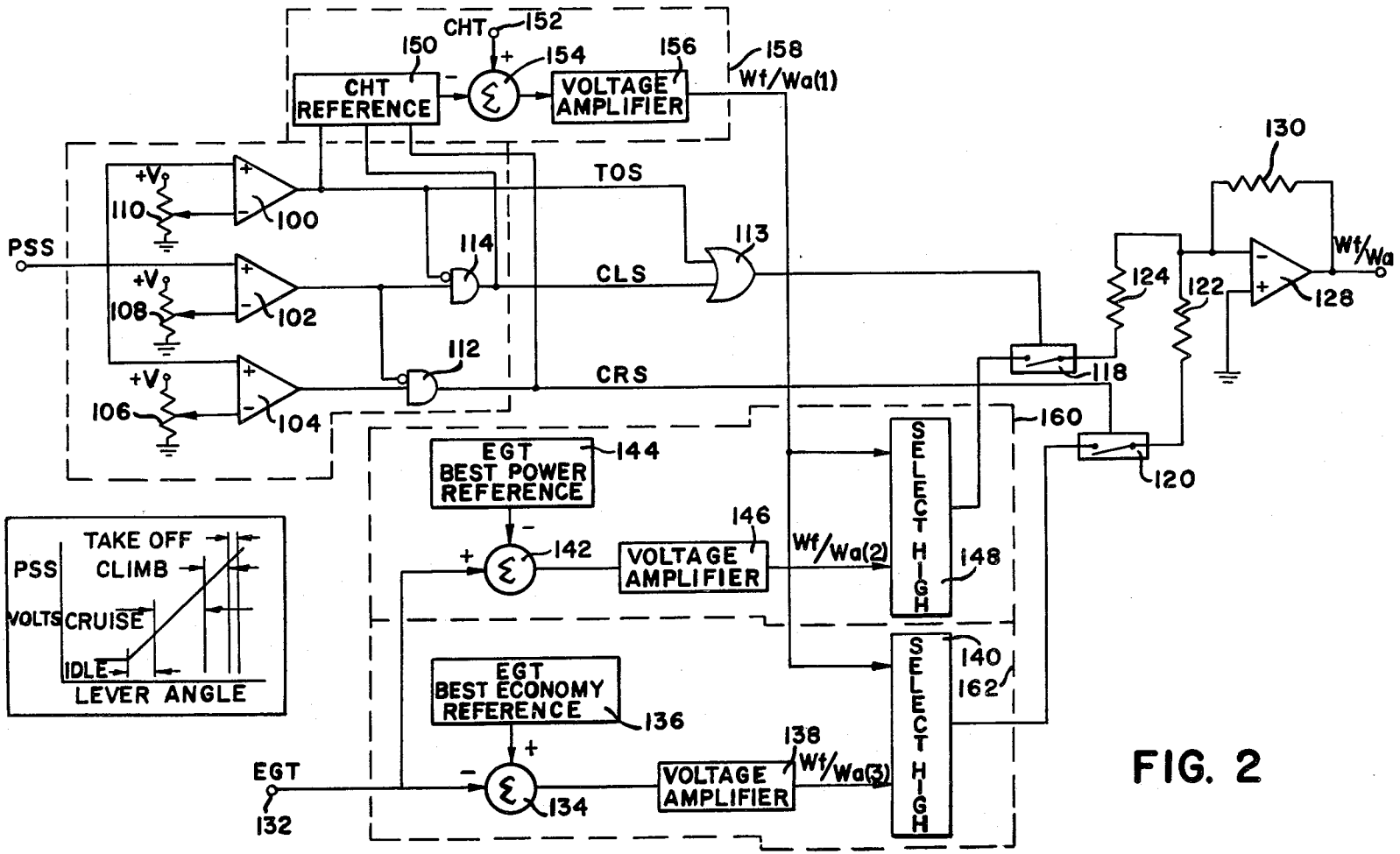
FIG. 2 is a detailed electrical schematic diagram of the fuel air/ratio controller illustrated in FIG. 1.

With respect now to FIG. 2, there is shown a detailed block diagram of the flight condition indicator and the electronic control 39 of the fuel/air ratio controller 40. The flight condition indicator receives an input from the prop speed lever 22 which is an analog (voltage) signal PSS varying as a function of lever angle. For example, the signal PSS may be generated from a rotary potentiometer outputting a voltage proportional to the angle of the prop speed lever 22. The signal PSS is shown in the accompanying schedule of lever angle for the associated flight condition. From this position signal the flight condition indicator 15 determines the flight condition the pilot desires and outputs one of three signals TOS, CLS, CRS, to indicate the condition. The first signal that the flight condition indicator 15 outputs is a takeoff signal, TOS, the second a climb signal, CLS, and the third a cruise signal, CRS.

The takeoff signal, TOS, is developed as the output of an operational amplifier 100 having its noninverting input connected to the prop speed signal PSS. The inverting input of the amplifier 100 is connected to the adjustment wiper of a variable resistor 110 connected between a voltage source +V and ground. The climb signal CLS is the output of an AND gate 114 which has as its inputs the positive true output of an operational amplifier 102 and the negative true output of the takeoff signal TOS. The operational amplifier 102 has its noninverting input connected to the prop speed signal PSS and its inverting input connected to the adjustment of a variable resistor 108 connected between a positive source of voltage +V and ground. The cruise signal CRS is developed as the output of an AND gate 112 having as its inputs the positive true output of an operational amplifier 104 and the negative true output of the operational amplifier 102. The operational amplifier 104 has its noninverting input connected to the prop speed signal PSS and its inverting input connected to the adjustable wiper of a variable resistor 106 connected between a source of positive voltage +V and ground.

In operation the flight condition indicator 15 decodes the position of the prop speed signal PSS by voltage level to produce the mode signals TOS, CLS, and CRS. Each of the variable resistors 106, 108, and 110, respectively, provide a threshold voltage associated with the particular mode that is to be decoded. In the schedule of prop speed signal PSS versus lever angle, it is illustrated that a threshold voltage set at the lowest point of the takeoff range will provide a positive output from the operational amplifier 100 when the prop speed lever is moved into the takeoff range. The takeoff signal TOS is thus generated when the prop speed lever is any place in the takeoff range but at no other position.

In a similar manner the variable threshold from resistor 108 for amplifier 102 may be set as the lowest voltage in the climb range of the prop speed schedule. The output of the operational amplifier 102 will therefore be positive whenever the prop speed lever signal PSS is above this point. To differentiate between the different modes of climb and takeoff, the AND gate 114 receives the positive input from the operational amplifier 102 indicating that the prop speed lever is above the climb threshold voltage. The negative true input from the output of the operational amplifier 100, however, disables the AND gate 114 when the prop speed lever enters the takeoff range. The climb signal CLS is thus generated when the prop speed lever is any place in the climb range, but at no other position.

Likewise, the variable resistor 106 may be set to a threshold voltage indicative of the lowest point of the cruise range of the schedule. This will provide a positive output from the amplifier 104 whenever the prop speed signal PSS is above that point. This signal becomes the cruise signal CRS if the AND gate 112 is enabled by the negative true input from operational amplifier 102. This input is enabled when the output of the amplifier 102 is a logical zero which indicates that the prop speed signal PSS has not increased to the climb threshold. Thus, the AND gate 112 generates the cruise signal CRS only when the prop speed signal PSS is between the cruise threshold and the climb threshold or in the cruise range.

The takeoff signal TOS, climb signal CLS, and the cruise signal CRS are used to regulate the closure of switches 118, and 120 by applying the signals to their control terminals. Switches 118 and 120 are solid state switches which are normally open and connected by one terminal, respectively, to fuel/air ratio control loops 160 and 162. The other terminals of the switches 118, and 120, are connected commonly to the inverting input of an operational amplifier 128 through impedances 124, and 122, respectively. The outputs from the control loops depending upon the closures of the switches 118, and 120 then are inverted in the voltage amplifier 128 to become the fuel/air ratio signal Wf/Wa to the fuel metering apparatus 32.

Switch 118 is closed in response to either a climb signal, CLS, or a takeoff signal TOS output from an OR gate 113. Switch 120 is closed in response to the cruise signal, CRS, only. Since these modes cannot occur simultaneously, the controller will be in one or the other of the two modes. The first mode, when switch 118 is closed, will be termed the best power mode and the second mode with switch 120 closed will be termed the best economy mode.

The fuel/air ratio control loops 160, 162 provide desired fuel/air ratio signals Wf/Wa, (1), (2), or (3) which are a function of either of the cylinder head temperature CHT, or exhaust gas temperature EGT. In the preferred embodiment, a fuel/air ratio signal Wf/Wa (1) which is a function of cylinder head temperature or a fuel/air ratio signal Wf/Wa (2), which is a function of either exhaust gas temperature EGT at a best power reference is provided by control loop 160, and a fuel/air ratio signal, Wf/Wa (3), which is a function of exhaust gas temperature EGT at a best economy reference of fuel/air ratio signal Wf/Wa (1) is provided by control loop 162.

The first loop 158 comprises a summing means 154 which receives as a positive input the signal CHT representative of the cylinder head temperature and differences it with a reference voltage from a circuit 150. The reference voltage is termed the CHT reference and is set by the condition (takeoff, climb, or cruise) under which the aircraft is operating. The error difference between the actual cylinder head temperature CHT and the reference is used for input to a voltage amplifier 156. The amplifier 156 schedules a voltage output Wf/Wa (1) indicative of a desired fuel air/ratio. The voltage output is scheduled as a function of the error difference and is provided with a lower and an upper limit. Preferably between this lower and upper limit, the fuel/air ratio is scheduled as a linear function of the error.

The second control loop 160 includes a summing means 142 which receives as an input the actual exhaust gas temperature signal EGT. Another input to summing means 142 is a reference voltage generated by circuit 144 which is indicative of the exhaust gas temperature for the best power from the engine. This best power reference is subtracted from the actual value of EGT and the error used to control a voltage amplifier 146.

The amplifier 146 outputs a voltage representative of a desired fuel/air ratio Wf/Wa (2) to one input of a select high gate 148. The amplifier 146 schedules its voltage output as a function of the error difference between the best power reference and the actual exhaust gas temperature signal EGT. Preferably the amplifier 146 has a lower fuel/air ratio limit and upper fuel/air ratio limit between which the output is scheduled as a linear function of the error difference.

The other input to the select high gate 148 is the fuel/air ratio signal Wf/Wa (1) from the control loop 158 which is a function of the cylinder head temperature CHT. The select high gate will sample the two voltage signals from amplifier 146 and amplifier 156 to determine which fuel/air ratio is the highest (richest). It will then output the higher signal Wf/Wa (1) or Wf/Wa (2) to the input terminal of switch 118.

The third control loop 162, comprises a summing means 134 which receives as an input a reference voltage from a circuit 136 indicative of the exhaust gas temperature giving the best economy from the engine. The other input to the summing means 134 is the exhaust gas temperature signal EGT representative of the actual exhaust gas temperature of the engine. The actual EGT signal is subtracted from the best economy reference and the error difference input to an amplifier 138. The amplifier 138 schedules a output which is a voltage indicative of a desired fuel/air ratio Wf/Wa (3). The amplifier 138 preferably has an upper and lower fuel/air ratio limit between which the error difference from summing means 134 is scheduled. Between these limits the output of the amplifier 138 is scheduled as a linear function of the error difference.

Additionally, the output from the amplifier 138 which is the fuel/air ratio signal Wf/Wa (3) is compared with the output of the amplifier 156 in a select high gate 140. The select high gate 140 compares the voltages and selects the higher (richer) air ratio of the two and transmits it to the input terminal of switch 120.

The overall operation of the circuit will now be explained for producing the most efficient operation of an aircraft. When the pilot is operating the aircraft and he desires a takeoff mode he will move the prop speed lever to the takeoff position. The flight condition indicator 15 will recognize this condition and generate the takeoff signal TOS which closes switch 118. While switch 118 is closed the system is controlled by the fuel/air ratio signal Wf/Wa (2) output to the fuel metering apparatus 32 from the control loop 160. During this period, the control loop 160 is scheduling the fuel/air ratio of the engine as a function of the exhaust gas temperature for the best power.

After takeoff has been accomplished, the pilot will retard the prop speed lever into the climb range and the flight condition indicator 15 will decode this movement as the climb signal CLS. During the climb phase of the flight the fuel/air ratio signal Wf/Wa (2) will again be scheduled as a function of the exhaust gas temperature for the best power output from the engine. This fuel/air ratio signal is provided to the fuel metering apparatus 32 by closing the switch 118 with the climb signal CLS.

When sufficient altitude has been reached the pilot will desire to enter a cruise flight condition. He accomplishes this by retarding the prop speed lever into the cruise range which generates the cruise signal, CRS, from the flight condition indicator 15. The generation of the cruise signal CRS closes the switch 120 and opens switch 118 to provide the fuel/air ratio signal Wf/Wa (3) from the control loop 162. While in this mode, the control loop 160 is scheduling the fuel/air ratio of the engine as a function of the exhaust gas temperature for the best economy.

During either the best power or best economy mode of operation it is noted that the control loop 158 is reserved as a limit function for producing a higher or richer fuel/air ratio if the cylinder head temperature is approaching unwanted levels. Thus, the select high gates 148 and 140 will override the exhaust gas temperature best power and best economy fuel/air ratios if the engine is overheating and provide the fuel/air ratio Wf/Wa (1).

Figure 4:
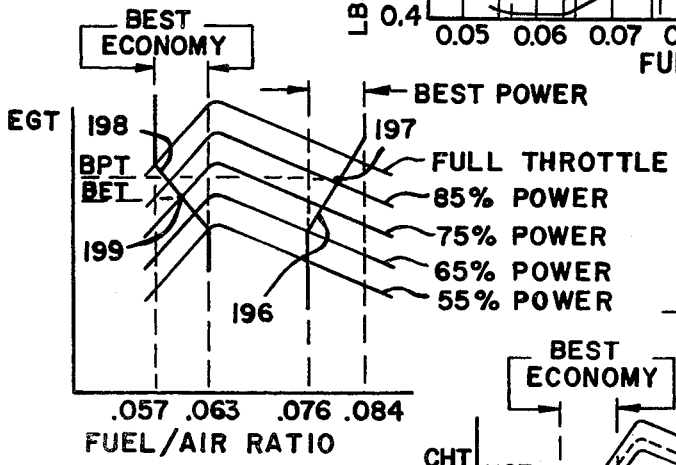
FIG. 4 is a pictorial illustration graphically indicating a family of exhaust gas temperature curves as a function of fuel/air ratio at different power settings for a reciprocating aircraft engine.

FIG. 4 graphically illustrates curves of exhaust gas temperature as a function of fuel/air ratio for different power settings. The family of curves representing exhaust gas temperature as a function of fuel/air ratio are shown for full throttle to partial throttle. It is seen that each curve is similarly shaped with a peak near the stoichiometric fuel/air ratio. The curves decrease on either side of the peak with either increasing or decreasing fuel/air ratio with the slope on the lean side of stoichiometric being greater than the slope on the rich side of stoichiometric. The difference in the various curves is they peak at different exhaust gas temperatures when graphed as a function of power. The desired ranges of fuel/air ratio are readily apparent from these curves where a best power range lies on the rich side of stoichiometric in a wide band and encompasses fuel/air ratios of approximately 0.076 to 0.084. The best economy fuel/air ratios lie in a narrower band which is leaner than stoichiometric and encompasses a band of fuel/air ratios of approximately 0.057 to 0.063.

Within these ranges a best power temperature, BPT, and the best economy temperature, BET, can be selected to provide the fuel/air ratio control loops with the reference values. Preferably, the best power temperature, BPT, is selected as the point 197 where the fuel/air ratio schedule 196 for control loop 160 crosses the 85% power curve. The schedule 196 is developed by the gain and limiting voltages of the amplifier 146 and corresponds to fuel/air ratios which span the best power range. This places the desired fuel/air ratio Wf/Wa (2) in the center of the best power range for an actual exhaust gas temperature equivalent to BPT at the 85% power setting. Since the 85% power setting is the one at which most light aircraft climb, it is a particularly advantageous point from which to schedule. For power settings greater or lesser than this point, the linear schedule has been set up based upon error to control the fuel/air ratio within the best power range considering the limits of the control loop 160.

Similarly, the fuel/air ratio schedule 198 for the control loop 162 regulating the fuel/air ratio Wf/Wa (3) as a function of the best economy exhaust gas temperature BET overlays the set of fuel/air ratios defining the best economy range. The schedule 196 is developed by the gain and limiting voltages of the amplifier 133. The best economy temperature BET is selected as the location 199 where the linear schedule crosses the EGT curve for the 75% power setting. Since the 75% power setting is the condition which most light aircraft use during a maximum cruise flight condition, this point is particularly advantageous. For power settings greater or lesser than this point, a linear schedule controls fuel/air ratio within the best economy range considering the limits of the control loop 162.

The two control loops 160, 162, therefore, act as proportional controllers to keep the exhaust gas temperature within the selected economy or power range for any throttle setting. For example, assume that the power setting is operating at the 85% point, the controller is in the best power mode, and the actual exhaust gas temperature is below the best power temperature BPT. The amplifier 146 will note the error difference between the actual temperature and the reference temperature, BPT, and provide a fuel air ratio which is leaner than the best power temperature ratio. As is seen from the opposite slopes of the curve 196 and the 85% throttle curve, this leaner fuel/air ratio will tend to increase the exhaust gas temperature to where it starts to approach the best power temperature BPT. The closed loop will cause the actual exhaust gas temperature to increase to where it reaches the best power temperature, BPT, at which a fuel/air ratio in the best power range is reached. For perturbations that move the exhaust gas temperature in excess of the best power temperature, the fuel/air ratio schedule will increase the fuel/air ratio thereby tending to bring the actual exhaust gas temperature down.

The schedule is a linear schedule of the error difference between the best power temperature BPT and the actual exhaust gas temperature EGT and forms a proportional controller which will center the operating point of the engine at the desired fuel/air ratio. Similarly, when the controller is switched to the best economy mode, a proportional control is established to produce the operating point in the best economy range at the best economy temperature BET.

It is however, evident that the system will not center around the two reference points for power settings other than 85% for the best power mode and 75% for the best economy mode. The actual operating points of the system will occur at places (fuel/air ratios) where the schedules 196, 198 for either the best economy or best power mode cross the particular EGT curve associated with the particular actual power setting. The difference between the actual fuel/air ratio operating points and those for BPT, BET are, of course, related to the drop error of the proportional control loops. This departure from absolute optimum for many aircraft is not particularly critical since for inspection of FIG. 3, it is seen that over the best power range the percent of engine power developed by the engine is substantially 100%. Thus, a wide fuel/air ratio error developed by the droop of a proportional controller can be tolerated. Similarly, for the best economy range, it is noted that specific fuel consumption S.F.C. remains relatively constant throughout the best economy range. Power does drop off fairly rapidly at the leaner edge of the range but the engine still maintains approximately 90–95% power in the center of the range. It is also noted that in the best economy mode of operation, which will be selected by the pilot basically for partial throttles of 75% and lower, the engine does not tend to operate at power levels of less than approximately 93%.

Further, if it is intended to operate the control loops 160, 162 at a specific fuel/air ratio for all power settings in the best economy or best power mode, then the control loops can be modified or made more complex to take this into account. For example, instead of a proportional governing loop, an isochronous loop which integrates the droop error to zero will provide a different set point ahd thus fuel/air ratio for each power setting. Moreover, it is well within the skill of those in the art to provide a best power or best economy temperature as a reference point in a proportional control that is reset as a function of power lever angle. In either of the abovementioned cases the droop error of a proportional control can be eliminated and a single best power and best economy fuel/air ratio maintained over the entire range of power settings.

Figure 5:
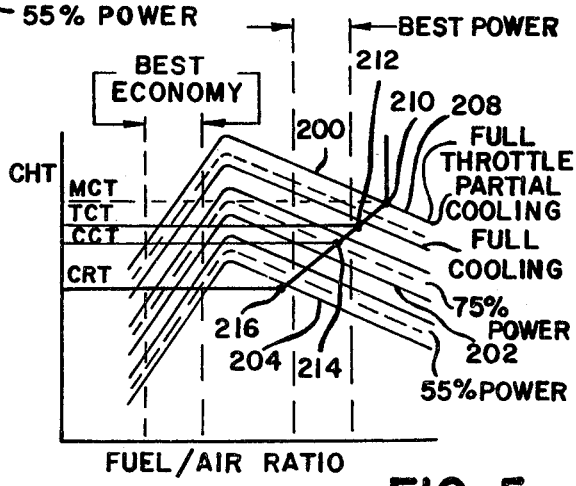
FIG. 5 is a pictorial illustration graphically illustrating a family of curves for cylinder head temperature as a function of fuel/air ratio for a reciprocating aircraft engine.

With reference now to FIG. 5 there is shown a family of curves for the cylinder head temperature as a function of fuel/air ratio. The curves for this particular illustration demonstrate that the cylinder head temperature is additionally not only a function of power but also the cooling capacity of the engine. This produces a family of curves 200, 202, and 204 at different power settings which vary with the efficiency of the engine cooling. The upper curve for each set illustrates those conditions at which the engine is not sufficiently cooled by normal means. These conditions include low ambient air densities which indicate a high temperature, humidity conditions, or an altitude climb with possibly the cowl flaps closed. The lower curve of each set represent those conditions at which the air is denser and cooler and/or with cowl flaps fully open.

A critical parameter of an engine in this operational mode is the maximum cylinder head temperature MCT that the engine will withstand without damage. Normally, at the power settings for takeoff and cruise with fuel/air ratios that could be used for best power this cylinder head temperature limit is not exceeded on many days even when somewhat inefficient cooling takes place. There are, however, conditions under which for takeoff and full throttle the temperature MCT will be exceeded. These conditions must have increased fuel/air ratio in excess of best power for cooling purposes. The severest maximum throttle cooling point 210 dictates the richest fuel/air ratio mixture which must be provided to permit cylinder cooling. This point indicates the fuel/air ratio which under full power conditions will keep the cylinder head temperature CHT below, MCT, for the severest cooling conditions.

The fuel/air ratio schedule 208 provided by the control loop 158 is illustrated overlaid on the CHT curves. The schedule is provided from the error signal by the gain and voltage limits of amplifier 154. The control loop 158 sets reference points 212, 214, and 216 based upon flight condition. These points corresponding, respectively, to temperatures TCT, CCT, and CRT are generated by circuit 150 in response to the TOS, CLS, and CRS signals from the flight condition indicator 15.

The takeoff signal TOS will cause circuit 150 to generate the reference temperature TCT. This reference is indicative of a cylinder head temperature slightly lower than the maximum MCT allowed during a takeoff condition. Generally, the cylinder head temperature of the aircraft will not exceed the TCT temperature for most takeoff operations. If, however, the actual cylinder head temperature reaches the temperature, TCT, the loop 158 will being to add fuel to the mixture for cooling purposes. Initially, the fuel/air ratio scheduled for the TCT reference value is that indicated at point 212 which is slightly richer than the best power range. Until the actual CHT reaches this point, fuel/air ratio will be metered by loop 162 for EGT based on best power because of the select high gate. Thereafter, for a CHT in excess of TCT during takeoff the loop 158 will proportionally increase fuel/air ratio beyond point 212 to cool the engine up to the richest ratio available at point 210.

For climb conditions (extended full power flight) a lower recommended cylinder head temperature should not be exceeded. This recommended temperature CCT is provided as a reference from circuit 150 upon the selection of a climb condition by the signal CLS. The fuel/air ratio scheduled for the CCT temperature at point 214 is slightly richer than the best power fuel/air ratio scheduled during climb conditions. Thus, until the actual CHT reaches the CCT point, the fuel/air ratio will be metered by loop 162 according to the EGT for best power because of the select high gate. Thereafter, for a CHT in excess of CCT during climb conditions, the loop 158 will proportionally increase fuel/air ratio up to the richest ratio available at point 210.

When the control is in a cruise condition, a best life cylinder head temperature, CRT, should not be exceeded. The reference point 216 associated with the temperature CRT is generated by the circuit 150 in response to a cruise signal CRS. The fuel/air ratio corresponding to point 216 is richer than the best economy fuel/air ratio set by loop 160 and is also richer than the peak clyinder head temperatures. Thus, until the actual CHT reaches the CRT point, the fuel/air ratio will be metered by loop 160 according to the EGT for best economy because of the select high gate. Thereafter, for a CHT in excess of CRT during cruise conditions, the loop will proportionally increase the fuel/air ratio up to the richest ratio available at point 210.

By using a cylinder head temperature reference for different flight conditions and proportionally controlling on that point with respect to the error difference with the actual cylinder head temperature, the engine will always attempt to operate at a high, but safe, cylinder head temperature while using a minimum of fuel. On days when the density of the air is greater, cooler, or when the pilot uses his cowl flaps to cool the engine while climbing, the fuel/air ratio used for cooling the cylinder heads can be reduced significantly. This allows the pilot to run essentially in the best power or best economy mode until the aircraft exceeds its cooling capacity and starts to approach cylinder head temperatures closer to critical cylinder head temperature limits.

Figure 6:
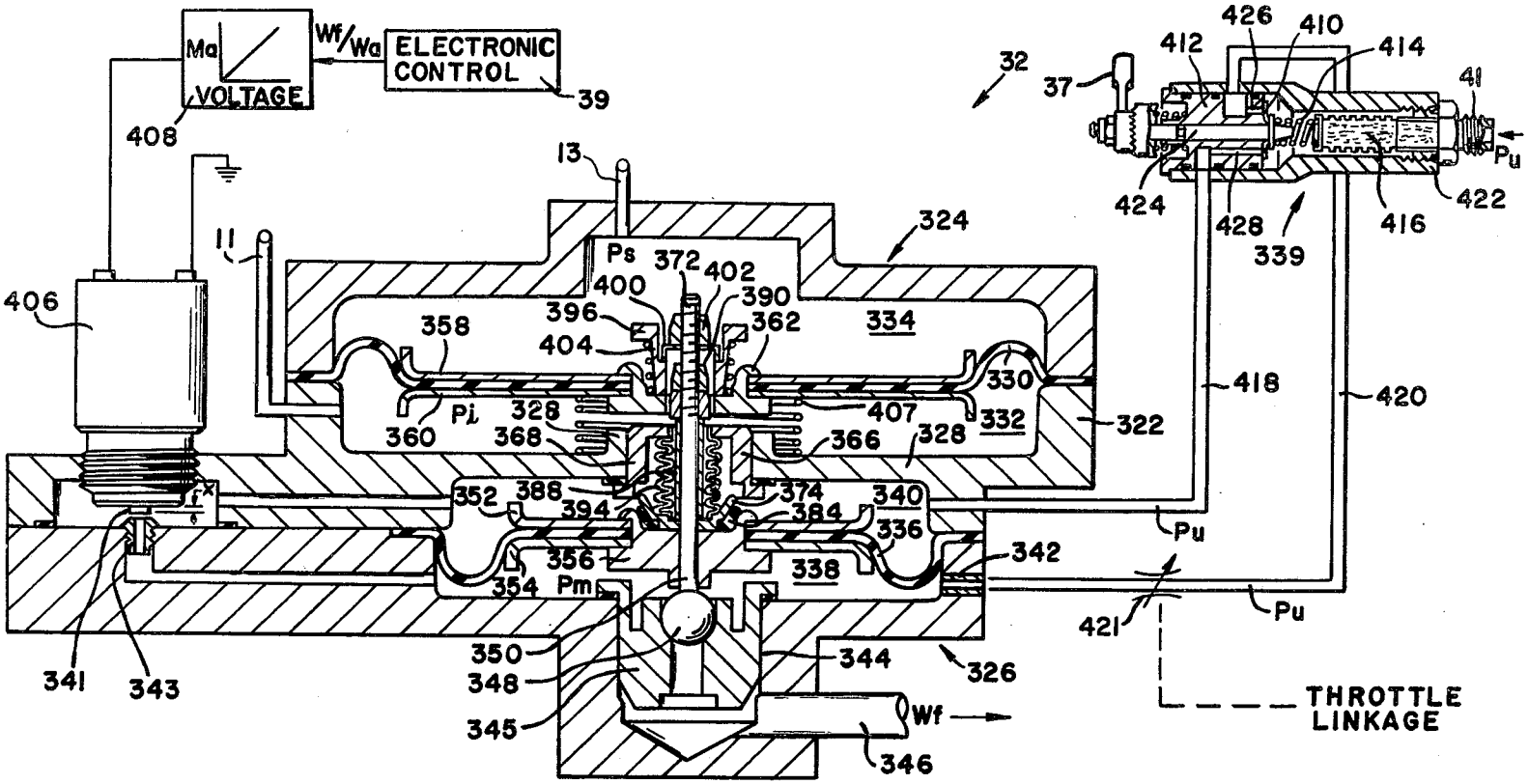
FIG. 6 is a detailed cross-sectional side view the fuel metering apparatus for the fuel/air ratio control illustrated in FIG. 1.

Referring now to FIG. 6 the fuel metering apparatus 32 will now be described in further detail. In general, the fuel metering apparatus 32 shown includes a multisection casing 322 having an air section 324 and a fuel section 326 separated by a wall 328. The air section 324 includes a diaphragm 330 fixedly secured in its outermost portion to casing 322 and separating a chamber 332 from a chamber 334. Chambers 334 and 332 are vented to the venturi static air pressure, Ps, and venturi impact air pressure, Pi, by conduits 11 and 13, respectively.

The fuel section 326 includes a diaphragm 336 fixedly secured at its outermost portion to casing 322 and separating a chamber 338 from a chamber 340. Chambers 338 and 340 communicate with pressurized fuel at pressures Pm and Pu, respectively, from the fuel supply conduit 41 after passing through a manual mixture control, generally 339. Fuel pressures Pm and Pu are derived from the upstream and downstream sides respectively, of two parallel fuel metering orifices generally indicated at 342 and 343 disposed in a flow-controlling position for fuel section 326. The fuel pressure differential Pm - Pu across the metering orifices 342, 343 for a given effective cross-sectional area of the parallel orifices determines the rate of metered fuel flow.

Metering orifice 342 is fixed in area while the effective cross-sectional area of metering orifice 343 is controllable by the movement of a valve 341 forming the armature of a proportional solenoid 406. The valve 341 is movable in response to an electrical fuel/air ratio signal Wf/Wa through a distance X which allows the orifice 343 an infinitely variable cross-sectional area between fully open and fully closed. Preferably, the fuel/air ratio signal Wf/Wa is generated by the electronic control 39 as a voltage which can be converted to a current by driver 408. The current from the driver 408 linearly regulates the positioning of the valve 341 with respect to orifice 343 and therefore pressure Pm.

While the means for varying the cross-sectional area of orifice 343 has been described as a proportional solenoid 406, various other means for accomplishing this function are available. There are a number of electrically controllable devices which may be used to position a valve with respect to an orifice such as a stepper motor, torque motor, or the like.

A manual mixture control 339 comprises a generally cylindrical member 412 mounted in a center bore of a tubular casing 422. Fuel under pressure Pu, from supply conduit 41 entering the bore of casing 422 is filtered by a filter 416 and then carried by internal passages 426, 428 of member 412 to conduits 418, 420. Rotatably adapted to vary the cross-sectional areas of the internal passages 426, 428 is a manual mixture valve 410 connected mechanically by pin 424 to manual mixture lever 37.

Rotation of the lever 37 to the automatic or full rich position opens passages 426, 428 to where fuel metering is regulated by orifices 342, 343. However, the lever 37 may be rotated to vary the passage areas with valve 410 to lean out fuel/air ratio manually to any point desired. In the extreme full lean position valve 410 acts to block passages 426, 428 totally and operate as a fuel cutoff control.

The chamber 338 is provided with a fuel outlet defined by an annular valve seat 345 fixedly secured in an opening 344 of casing 322 by any suitable means such as a press fit. The opening 344, in turn, discharges fuel to a passage 346 which feeds fuel to the flow divider 34. The effective flow area of the valve seat 345 is controlled by the position of a ball valve 348 adapted to seat thereon. The ball valve 348 is fixedly secured to one end of a rod or actuator stem 350 and is positioned relative to the valve seat 345 in response to a force balance derived from diaphragms 330 and 336.

The fuel diaphragm 336 is provided with backing plates 352 and 354 which are clamped against opposite sides thereof by retaining member 356 suitably upset or otherwise connected to provide a rigid assembly. The rod 350 is axially aligned with diaphragm 336 and extends through retaining members 356 which is fixedly secured to the rod 350 by any suitable means such as brazing or the like.

The air diaphragm 330 is provided with backing plates 358 and 360 clamped against opposite sides thereof by retaining member 362 suitably upset or otherwise connected to provide a rigid assembly. The rod 350 extends through an opening in a cup-shaped fitting 366 which in turn is fixedly secured in an opening 368 of wall 328 by any suitable means such as a press fit to provide a fluid seal between the fuel and air section. The rod 350 also extends through the center of opening 374 and retaining member 362 and is provided with a threaded portion 372.

A circular fitting 374 through which rod 350 extends is provided with a radially extending flange 388 the outermost portion of which is angled to define a stop portion engageable with fitting 366 to thereby limit axial travel of rod 350. The fitting 374 is adapted to seat against an annular flexible seal such as a conventional O-ring 384 contained by a recess of retaining member 356. The seal 384 is compressed between fitting 374 and retaining member 356 to provide a fluid seal therebetween.

The fitting 374 is urged against the seal 384 by a sleeve 388 slidably received on rod 350. The annular spacing member 390 slidably received on rod 350 bears against sleeve 388 and is secured in position axially by a lock nut threadedly secured on threaded portion 372. The spacing member 390 is received by an opening in retaining member 362 with sufficient clearance provided between the adjacent walls of spacing member 390 and retaining member 362 to allow slidable movement therebetween with a minimum of air leakage therethrough from chamber 334 to chamber 332.

A bellows 394 surrounding rod 350 is fixedly secured at opposite ends to fitting 366 and 374, respectively, by suitable means such as soldering or the like to provide a positive seal against fluid leakage between air and fuel on opposite sides. It will be understood that the bellows 394 is relatively small in diameter and formed of a suitable layer of thin metal to reduce to a minimum the spring rate of bellows 394. Therefore, it will be understood that the force involved in the compression of bellows 394 is minor may be neglected or easily compensated for. Limits to the compression and expansion of bellows 394 are established by engagement of the stop of fitting 374 with the fitting 366 or the seating of valve 348 against the seat 345, respectively. The mean effective area of bellows 394 is selected to be equal to the flow area of the valve seat 345 which results in the force derived from pressure Pm against the valve 348 and tending to seat the same being equalized by an opposing substantially equal force.

An annular spring retaining member 396 is provided having a central opening equivalent in diameter to that of the opening in retaining member 362. A cup-shaped member 400 slidably received by the rod 350 is arranged with its rim portion abutting annular retaining member 396. A lock nut 402 engaged with threaded portion 372 and bearing against cup-shaped member 400 retains cup-shaped member 400 and retaining member 396 bearing against the latter in position on rod 350. A compression spring 404 interposed between retaining member 396 and retaining member 362 provides a predetermined force preload tending to urge the same apart. A compression spring 407 interposed between wall 328 and diaphgram 330 imposes a predetermined force preload on diaphragm 330 in opposition to compression spring 404. In general spring 406 serves to maintain a substantially constant preloading against diaphragm 330 which preload assist the pressure differential Pi−Ps across diaphragm 330 to thereby maintain a substantially constant linear relation between the fuel pressure differential Pu−Pm and the air pressure differential Pi−Ps at relatively low values of the latter.

The spring 404 is extended at low air flow when the air pressure differential Pi−Ps across diaphragm 30 is correspondingly low and results in retaining member 362 being biased against casing 322 which acts as a stop. The opposite end of spring 404 which bears against retaining member 396 serves to load stem 350 in a direction to open ball valve 348. The pressure differential Pu−Pm across diaphragm 336 required to balance the force of the spring 404 results in a constant fixed Pu−Pm pressure.

At low air flows or at idle conditions of the engine, the fuel/air mixture is controlled by allowing the solenoid 406 to remain open and restricting flow through orifice 342 with an idle valve 421 which is mechanically connected to the throttle linkage. After the throttle moves from an off idle position, the valve 421 becomes fully open and solenoid 406 sets the fuel/air ratio by positioning valve 341.

In operation, the pressure differential Pu−Pm generates a fuel flow proportional thereto and pressure differential Pi−Ps varies this fuel flow in concert with the mass airflow into the engine by balancing the forces on rod 350. Therefore, by varying the cross-sectional area of the controlled orifice 343 and hence pressure Pm, the output, Wf, will be a scheduled fuel/air ratio for any mass airflow.

When the orifice 343 is fully open, the device will provide the maximum or richest fuel/air ratio availabe from the apparatus. Conversely, when orifice 343 is completely closed by valve 341 the fuel/air ratio is controlled only by the area of orifice 342 and is the leanest available. Between these extremes is an infinitely variable range of fuel/air ratios which is determined by the electrical signal positioning the valve 341.

Preferably, the solenoid 406 positions valve 341 fully open when no current is applied from the driver 408 and positions the valve fully closed when maximum current is applied. This provides a failure mode for the electronic control that is fail-safe because if current is interrupted the fuel/air ratio level becomes full-rich. The engine mixture is still able to be controlled by the manual mixture control 339 which is then moved off of full rich or automatic to produce manual lean out.

While the preferred embodiments of the invention have been shown and described, it will be obvious to those skilled in the art that various modifications and variations may be made thereto without departing from the spirit and scope of the invention as hereinafter defined in the appended claims.

What is claimed is:

1. Fuel/air ratio control apparatus for a reciprocating aircraft engine having a cylinder head and generating exhaust gas during engine operation, said apparatus comprising a fuel metering device for regulating fuel flow to the engine as a function of the air flow through the engine and a fuel ratio control signal which varies as a function of a desired fuel/air ratio, and means for generating said fuel ratio control signal, said fuel ratio control signal generating means including exhaust gas temperature sensing means for generating an exhaust gas temperature signal which varies as a function of the temperature of the exhaust gas, first signal generating means for generating a first temperature signal representing an exhaust gas temperature at which optimum power is produced by the engine, second signal generating means for generating a second temperature signal representing an exhaust gas temperature at which optimum fuel economy is obtained from the engine, means for generating a first control signal as a function of the difference between said exhaust gas temperature signal and the first temperature signal, means for generating a second control signal as a function of the difference between said exhaust gas temperature signal and the second temperature signal, means for generating an engine speed signal as a function of the speed of the engine, and means responsive to said engine speed signal for selecting one of said first or second control signals as said fuel ratio control signal.

2. Fuel/air ratio control apparatus as claimed in claim 1, and second temperature sensing means for generating a cylinder head temperature signal as a function of the temperature of the cylinder head, means for generating a cylinder head reference signal representing a predetermined maximum cylinder head temperature, means for generating a difference signal which varies as a function of the difference between the cylinder head temperature signal and said cylinder head reference signal, and means for overriding said first control signal generating means and said second control signal generating means to generate said first and second control signals as functions of said difference signal when the valve of the difference signal exceeds the valve of said first or second control signal generated by said first control signal generating means and said second control signal generating means.

3. Fuel/air ratio control apparatus as claimed in claim 2, wherein said cylinder head reference signal is varied as a function of engine speed.

4. Fuel/air ratio control apparatus as claimed in claim 3, wherein said engine speed signal generating means includes comparator means for generating a first reference signal when the speed of the engine exceeds a predetermined speed and a second reference signal when the speed of the engine is below said predetermined speed, the cylinder head reference signal being set at a first valve in response to the first reference signal and at a second valve in response to the second reference signal.

5. Fuel/air ratio control apparatus as claimed in claim 2, wherein said overriding means includes means for selecting the greater of the difference signal and the output of said first control signal generating means as said first control signal, and means for selecting the greater of said difference signal and the output of said second control signal generating means as said second control signal.

6. Fuel/air control apparatus as claimed in claim 1, wherein said engine speed signal generating means includes comparator means for generating a first reference signal when the speed of the engine exceeds a first predetermined speed and a second reference signal when the speed of the engine is below said predetermined speed, said engine speed signal responsive means selecting said first control signal in response to said first reference signal and selecting said second control signal in response to the second reference signal.

7. Fuel/air ratio control apparatus as claimed in claim 4, wherein said engine speed signal responsive means selects said first control signal in response to said first reference signal and selects said second control signal in response to the second reference signal.

* * * * *